US005292068A

United States Patent [19]

Raterman et al.

[11] Patent Number: 5,292,068

[45] Date of Patent: Mar. 8, 1994

[54] ONE-PIECE, ZERO CAVITY NOZZLE FOR SWIRL SPRAY OF ADHESIVE

[75] Inventors: John M. Raterman, Lawrenceville; Scott R. Miller, Roswell; Roger A. Ziecker, Lawrenceville, all of Ga.

[73] Assignee: Nordson Corporation, Westlake, Ohio

[21] Appl. No.: 930,773

[22] Filed: Aug. 17, 1992

[51] Int. Cl.[5] ..... B05B 1/34; B05B 7/10

[52] U.S. Cl. ..... 239/11; 239/298; 239/135; 239/406; 239/412; 156/578

[58] Field of Search ..... 239/290, 294, 298, 133, 239/135, 403, 405, 406, 412, 474, 131, 8, 11; 156/578

[56] References Cited

U.S. PATENT DOCUMENTS

| | | | |
|---|---|---|---|
| Re. 33,481 | 12/1990 | Ziecker et al. | 239/298 |
| 1,990,823 | 2/1935 | Gustafsson . | |
| 2,303,280 | 11/1942 | Jenkins . | |
| 2,626,122 | 1/1953 | Lammiman . | |
| 3,379,811 | 4/1968 | Hartmann et al. . | |
| 3,421,702 | 1/1969 | O'Brien . | |
| 3,659,151 | 4/1972 | Fabre | 239/298 |
| 3,888,649 | 6/1975 | Simhan | 118/48 |
| 4,031,854 | 6/1977 | Sprague, Jr. | 118/302 |
| 4,055,300 | 10/1977 | Binoche | 239/296 |
| 4,465,212 | 8/1984 | Boone | 222/504 |
| 4,502,629 | 3/1985 | McGhee et al. | 239/296 |
| 4,537,357 | 8/1985 | Culbertson et al. . | |
| 4,669,661 | 6/1987 | Otto | 239/133 |
| 4,785,996 | 11/1988 | Ziecker et al. | 239/600 |
| 4,815,660 | 3/1989 | Boger | 239/8 |
| 4,891,249 | 1/1990 | McIntyre | 239/300 |
| 4,969,602 | 11/1990 | Scholl | 239/298 |
| 4,983,109 | 1/1991 | Miller et al. | 239/298 |
| 4,993,643 | 2/1991 | Hufgard . | |
| 5,020,723 | 6/1991 | Crist | 239/405 |
| 5,065,943 | 11/1991 | Boger et al. | 239/298 |
| 5,090,623 | 2/1992 | Burns et al. . | |
| 5,169,071 | 12/1992 | Boger et al. | 239/600 |
| 5,194,115 | 3/1993 | Ramspeck et al. | 239/298 |
| 5,209,405 | 5/1993 | Robinson et al. . | |

FOREIGN PATENT DOCUMENTS

| | | |
|---|---|---|
| 0377926 | 7/1990 | European Pat. Off. . |
| 2548555 | 1/1985 | France . |
| 656824 | 9/1951 | United Kingdom . |
| 0327296 | 8/1989 | United Kingdom . |
| 0381072 | 8/1990 | United Kingdom . |

*Primary Examiner*—Andres Kashnikow
*Assistant Examiner*—Christopher G. Trainor
*Attorney, Agent, or Firm*—Wood, Herron & Evans

[57] ABSTRACT

A one-piece nozzle adapted for use within an adhesive dispenser includes a nozzle body formed with a throughbore having a discharge outlet within a nozzle tip portion which emits a bead of adhesive. A nozzle cap mounts the nozzle body to the adhesive dispenser such that an adhesive passageway within the dispenser communicates with the throughbore in the nozzle body and a plunger valve associated with the adhesive dispenser extends into the nozzle body in position to engage a seat formed at the nozzle tip. A number of air jet bores are drilled in the nozzle body, each communicating with an air passage formed between an outer surface of the nozzle body and an inner surface of the nozzle cap, which discharge jets of air into contact with the adhesive bead producing an elongated adhesive fiber deposited in a spiral pattern onto a substrate.

21 Claims, 2 Drawing Sheets

ONE-PIECE, ZERO CAVITY NOZZLE FOR SWIRL SPRAY OF ADHESIVE

FIELD OF THE INVENTION

This invention relates to adhesive dispensing apparatus, and, more particularly, to a one-piece, zero cavity nozzle which is adapted for use with an adhesive dispenser to apply an elongated strand or fiber of adhesive in a controlled, spiral spray pattern onto a substrate.

BACKGROUND OF THE INVENTION

Adhesive dispensing devices such as disclosed, for example, in U.S. Pat. Nos. 4,969,602 to Scholl; 5,065,943 to Boger et al; and, Re. 33,481 to Ziecker et al, all owned by the assignee of this invention, have been employed in a number of applications such as the manufacture of disposable diapers, incontinence pads and similar articles wherein a comparatively low adhesive application temperature and good bond strength are required using as little adhesive as possible. In dispensers of this type, a bead of adhesive is extruded from the adhesive discharge bore formed in a nozzle plate mounted to the nozzle of the dispenser. This adhesive bead is then impinged by air jets emitted from bores formed in the nozzle plate to attenuate or stretch the adhesive bead forming a thin fiber, and to then twist or swirl the fiber so that it is deposited in a spiral pattern onto the substrate. The flow of adhesive to the nozzle plate is controlled by the operation of a plunger valve carried by the adhesive dispenser which is movable between an open position and a closed position relative to the adhesive discharge bore in the nozzle plate.

The nozzle attachments or plates disclosed in U.S. Pat. Nos. 4,969,602; 5,065,943; and, Re. 33,481 satisfy many of the requirements associated with the manufacture of disposable diapers and similar articles, but certain limitations remain. One problem involves inefficient heat transfer to the adhesive as it flows from the adhesive dispenser and nozzle into the nozzle plate. Although the adhesive dispenser, and/or the manifold which supplies adhesive thereto, contain heating elements to maintain the temperature of the hot melt adhesive, no heaters are present within the nozzle portion of the dispenser. Heat transfer to the nozzle plate is therefore completely dependent on heat conduction from the dispenser body, through the nozzle and then to the nozzle plate. As a result, at least some temperature drop in the adhesive can occur in the course of its passage to the nozzle plate prior to discharge onto a substrate.

Another concern with adhesive dispensers having nozzle plates of the type disclosed in U.S. Pat. Nos. 4,969,602; 5,065,943; and, Re. 33,481 is leakage or drooling of adhesive from the nozzle plate, particularly when the adhesive dispenser is operated intermittently. As mentioned above, the adhesive dispenser includes a plunger movable with respect to the adhesive discharge bore in the nozzle plate to control the flow of adhesive thereto. In each of the nozzle plate designs disclosed in the patents mentioned above, a relatively large cavity is formed between the adhesive discharge bore in the nozzle plate and a seat within the nozzle which engages the tip of the plunger. Adhesive can pool or collect within this cavity and leak through the adhesive bore in the nozzle plate when the plunger is in a closed position. This creates stringing or drooling of adhesive which can clog the adhesive discharge bore and/or the air jet bores formed in the nozzle plate.

A still further potential concern with nozzle plates of the type described in the patents mentioned above is leakage of adhesive into the air jet bores of the nozzle plate at the point of introduction of the adhesive from the nozzle of the dispenser into the nozzle plate. In U.S. Pat. Nos. 4,969,602 and Re. 33,481, for example, a metal-to-metal seal is provided between the nozzle plate and the nozzle of the adhesive dispenser in the area between the adhesive discharge bore and air jet bores of the nozzle plate. Recognizing the potential difficulties with this type of a seal, U.S. Pat. No. 5,065,943 to Boger et al discloses a nozzle cap assembly in which an O-ring is interposed between the adhesive bore of the nozzle plate and its air jet bores so that when mounted to the nozzle of an adhesive dispenser an improved seal is created between the adhesive flow path and air flow path. While the construction disclosed in U.S. Pat. No. 5,065,943 is an improvement, the O-ring can become dislodged or lost during maintenance or cleaning of the nozzle cap, thus presenting a sealing problem when the cap is subsequently replaced.

SUMMARY OF THE INVENTION

It is therefore among the objectives of this invention to provide a one-piece nozzle, adapted for use with an adhesive dispenser, which applies an elongated strand or fiber of adhesive in a consistent spiral pattern onto a substrate, which avoids stringing or drooling of adhesive when the dispenser is operated intermittently and which avoids leakage of adhesive.

These objectives are accomplished in a nozzle adapted for use within an adhesive dispenser which comprises a one-piece nozzle body having a discharge end formed with a radially inwardly tapering outer surface and a nozzle tip. The nozzle body is formed with a stepped throughbore having a discharge outlet within the nozzle tip and a valve seat formed at the inlet to the nozzle. A nozzle cap, having a tapered inner surface, mounts the nozzle body to the adhesive dispenser such that an adhesive passageway within the dispenser communicates with the adhesive bore in the nozzle body and a plunger valve associated with the adhesive dispenser extends into the nozzle body in position to engage the seat formed at the nozzle tip. A number of air jet bores are drilled in the discharge end of the nozzle body, each of which communicate with an air passage formed between the outer surface of the nozzle body and the inner surface of the nozzle cap when the nozzle body and nozzle cap are assembled.

In response to movement of the valve plunger associated with the adhesive dispenser to an open position with respect to the seat at the nozzle tip, adhesive is allowed to flow into the discharge outlet of the nozzle tip from which it is ejected as an adhesive bead. Pressurized air is transmitted through the air passage formed between the outer surface of the nozzle body and inner surface of the nozzle cap to each of the air jet bores at the discharge end of the nozzle body. Jets of pressurized air emitted from the air jet bores impact the adhesive bead causing it to attenuate or stretch to form an elongated adhesive fiber. This adhesive fiber is then twisted or swirled by the air jets so that the fiber is deposited in a spiral pattern upon a substrate.

One important advantage of the above-described one-piece construction of the nozzle of this invention is that the nozzle attachment or plate employed in U.S.

Pat. Nos. 4,969,602; 5,065,943; and, Re. 33,481 is eliminated. As a result, the problem of leakage of the flow of adhesive into the air jet bores is avoided.

Additionally, the one-piece nozzle construction of this invention provides for a much more efficient transfer of heat from the heating elements in the adhesive dispenser and/or adhesive manifold to the nozzle tip where the adhesive bead is ejected. Heat is efficiently conducted through the entire, one-piece nozzle so that adhesive flowing therethrough is maintained substantially at temperature and not allowed to appreciably cool prior to discharge from the nozzle tip and contact with the jets of air. This produces a more consistent spiral pattern of an elongated adhesive fiber on a substrate.

In another aspect of this invention, the outer surface of the discharge end of the nozzle which faces the nozzle nut is preferably formed with an annular extension or baffle located in the path of the air flow within the air passage formed between the nozzle body and nozzle nut. As disclosed in detail in U.S. patent application Ser. No. 07/783,989, entitled "Loop Producing Apparatus", owned by the assignee of this invention, the presence of the baffle within the air passage assists in more evenly distributing the air flow to each of the air jet bores formed in the discharge end of the nozzle body. Additionally, it has been found that even air distribution to each of the air jet bores is enhanced by positioning the air inlet to the nozzle body at a location substantially at the midpoint between adjacent air jet bores. As a result of such air distribution, the spiral pattern of the elongated adhesive fiber is maintained at substantially constant width regardless of the angular position of the adhesive dispenser or nozzle with respect to a substrate.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
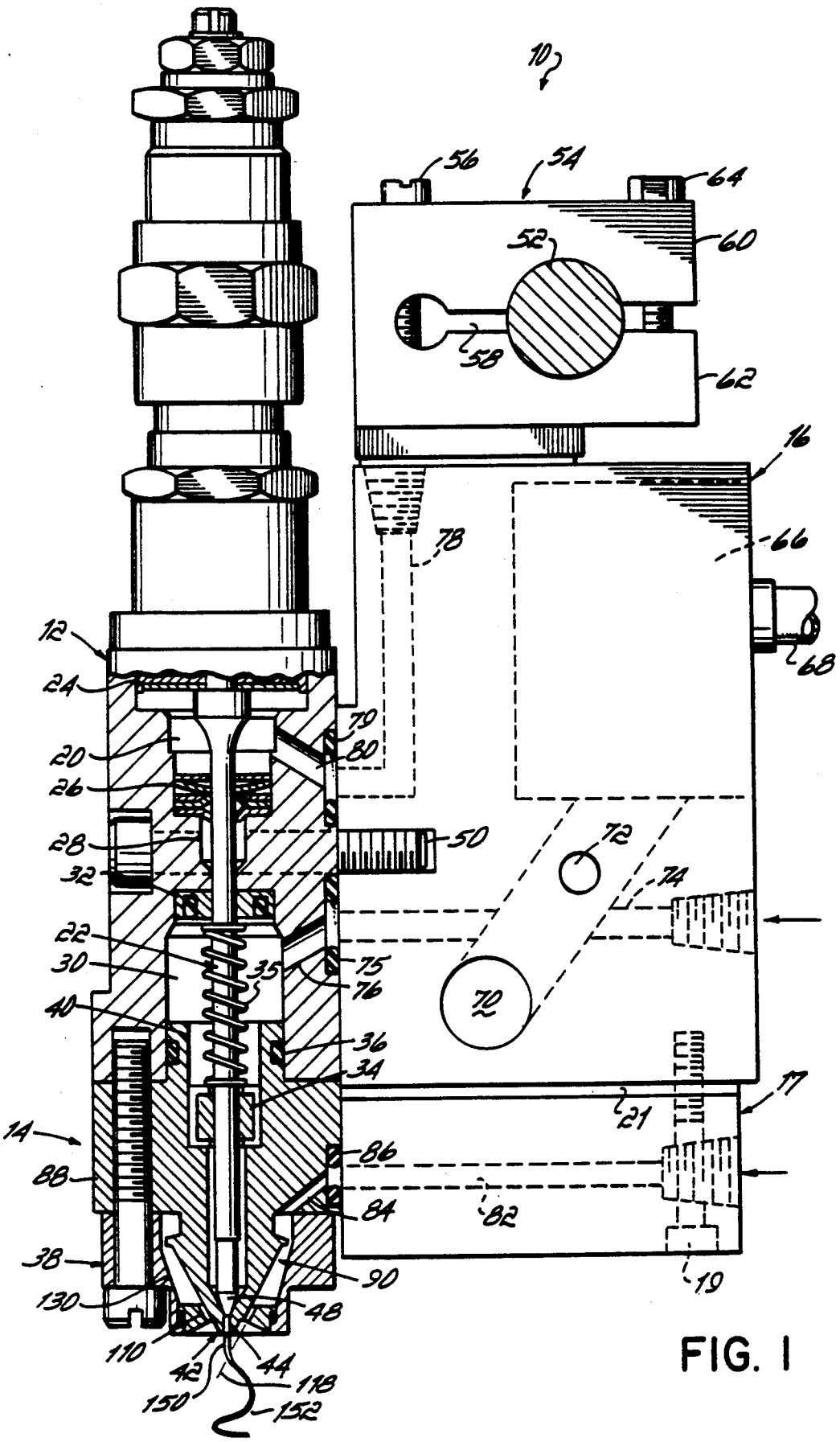
FIG. 1 is a partial cross sectional view of an adhesive dispenser incorporating the nozzle of this invention wherein an adhesive manifold and an air manifold are provided.

Referring now to FIG. 1, an adhesive dispenser 10 is illustrated comprising a dispenser body 12 having the nozzle 14 of this invention connected at one end. An adhesive manifold 16 is mounted to the dispenser body 12, which, in turn, carries an air manifold 17 connected thereto by two or more screws 19 each of which extends through a spacer 21 between the manifolds 16, 17. The structure of the dispenser body 12 is substantially identical to the Model H200 spray gun manufactured and sold by the assignee of this invention, Nordson Corporation of Amherst, Ohio. This structure forms no part of this invention and is therefore discussed briefly for purposes of background only.

As shown in FIG. 1, the upper portion of dispenser body 12 is formed with an air cavity 20 which receives the upper end of a valve plunger 22 mounted to a seal 24. The seal 24 is slidable within the air cavity 20 and provides an airtight seal along its walls. The plunger 22 is sealed at the base of the air cavity 20 by a seal 26 which permits axial movement of the plunger 22 therealong. The plunger 22 extends downwardly through the gun body 12 from the air cavity 20 through a stepped bore 28 which leads to an adhesive cavity 30 having a seal 32 at its upper end and a plunger mount 34 at its lower end. A spring 35 mounted to the plunger 22 is located within the adhesive cavity 30 and extends between the seal 32 and plunger mount 34. Both a narrow portion of the stepped bore 28 and the plunger mount 34 aid in guiding the axial movement of plunger 22 within the dispenser body 12.

The upper end of nozzle 14 extends into the adhesive cavity 30 and is sealed thereto by an O-ring 36. As described in more detail below, the nozzle 14 is fixed to the gun body 12 by a nozzle cap 38. The plunger 22 extends downwardly from the adhesive cavity 30 and plunger mount 34 into a stepped adhesive passageway 40 formed in the nozzle 14. This passageway 40 terminates at a frusto-conical shaped nozzle tip 42 formed with a discharge bore 44. The discharge bore 44 has a diameter in the range of about 0.010 to 0.040 inches, and preferably in the range of about 0.0175 to 0.0185 inches. Immediately upstream from the discharge bore 44 of nozzle tip 42, the adhesive passageway 40 within nozzle 14 is formed with a conical-shaped seat 46. This seat 46 mates with the tip 48 of the plunger 22 in position immediately above the discharge bore 44 in the nozzle tip 42 (see FIG. 2). As discussed below, movement of the plunger 22 relative to the seat 46 controls the flow of heated hot melt adhesive through the adhesive passageway 40 in nozzle 14 and into the discharge bore 44 of nozzle tip 48.

The gun body 12 is mounted to adhesive manifold 16 by mounting bolts 50. In turn, the adhesive manifold 16 is supported on a bar 52 by a mounting block 54 connected to the adhesive manifold 16 with screws 56. As illustrated at the top of FIG. 1, the mounting block 54 is formed with a slot 58 defining two half sections 60, 62 which receive the bar 52 therebetween. A bolt 64 spans the half sections 60, 62 of the mounting block formed by the slot 58 and tightens them down against the bar 52 to secure the mounting block 54 thereto.

The adhesive manifold 16 is formed with a junction box 66 which receives an electric cable 68 to supply power to a heater 70 and an RTD 72. The heater 70 maintains the hot melt adhesive in a molten state when it is introduced into the adhesive manifold 16 through an adhesive inlet line 74 connected to a source of hot melt adhesive (not shown). The dispenser body 12 is heated by conduction via its contact with the adhesive manifold 16, and the nozzle 14 conducts heat by contact with the dispenser body 12. The adhesive inlet line 74 in manifold 16 communicates through a connector line 76 formed in the dispenser body 12 with the adhesive cavity 30 therein. An O-ring 75 is provided between the dispenser body 12 and adhesive manifold 16 at the junction of the adhesive inlet line 74 and connector line 76 to form a seal therebetween. Operating air for the plunger 22 is supplied through an inlet line 78 formed in the adhesive manifold 16, which is joined by a connector line 80 to the air cavity 20. The dispenser body 12 and manifold 16 are sealed thereat by an O-ring 79.

The air manifold 17 is formed with an air inlet line 82 connected to an air connector bore 84 formed in the nozzle 14. O-ring seal 86 forms a fluid-tight seal between the nozzle 14 and air manifold 17 at the intersection of air inlet line 82 and air connector bore 84.

Figure 2:
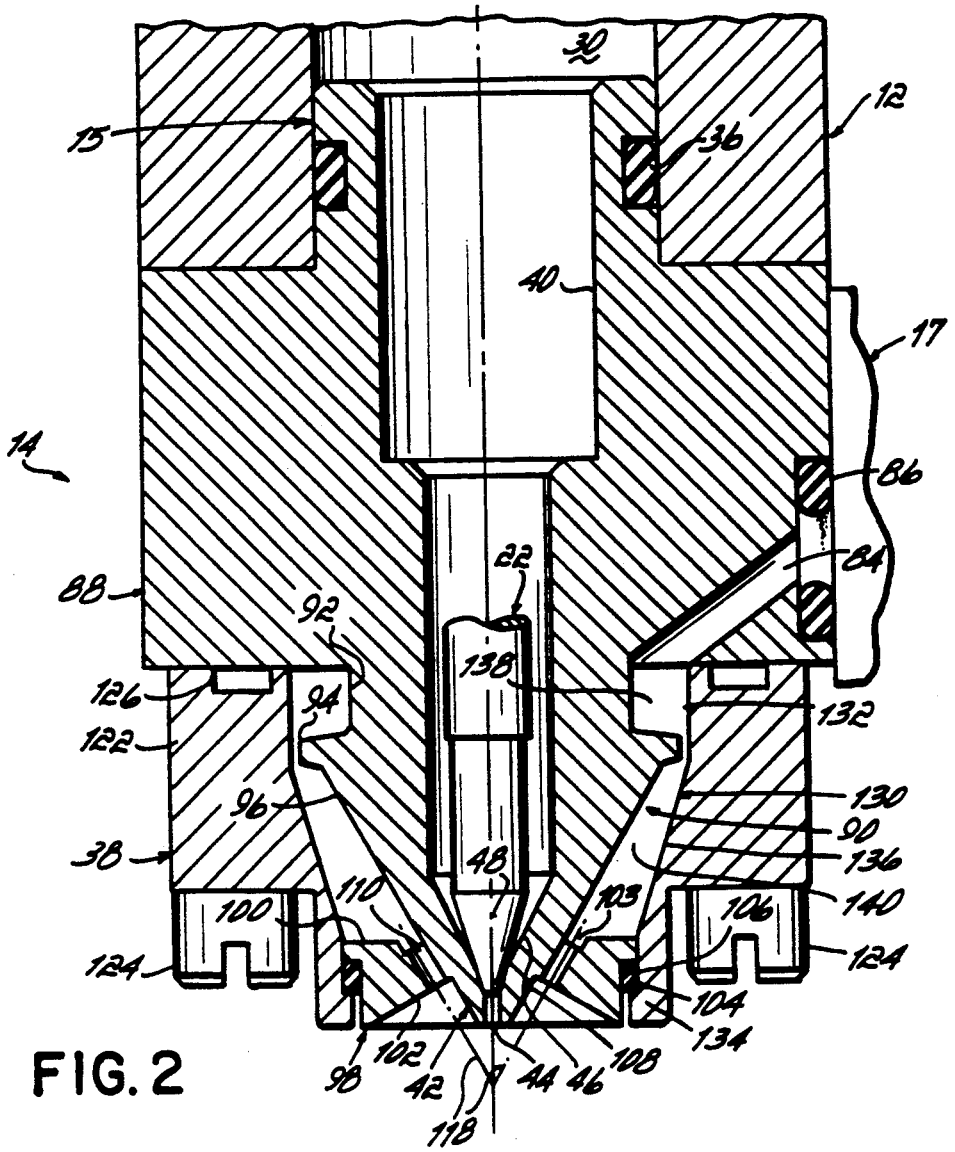
FIG. 2 is an enlarged cross sectional view of the nozzle of this invention.

Referring now to FIG. 2, the construction of the nozzle 14 and nozzle cap 38 is illustrated in more detail. As mentioned above, the upper end 15 of nozzle 14 extends into the adhesive cavity 30 formed in the dispenser body 12 where it is sealed by an O-ring 36. The nozzle 14 further includes a generally cylindrical-shaped center portion 88 and a discharge end 90. With reference to the bottom portion of FIG. 2, this discharge end 90 of nozzle 14 is formed with an annular recess 92 at its juncture with the center portion 88, which defines a radially outwardly extending, annular flange or baffle 94. The discharge end 90 of nozzle 14 is also formed with a radially inwardly tapering outer surface 96 extending between the baffle 94 and a disc 98 which is substantially concentric to the nozzle tip 42 of nozzle 14. The disc 98 is formed with an inner surface 100 which faces the baffle 94, and an outer surface 102 opposite the inner surface 100. An annular groove 103 is formed in the disc 98 which extends from the inner surface 100 toward the outer surface 102, and radially outwardly from the outer surface 96 of the discharge end 90. The periphery or circumferential edge of disc 98 is formed with a seat 104 which receives an O-ring 106 for purposes described in more detail below.

As depicted at the bottom of FIG. 2, the exposed surface 108 of nozzle tip 42 is formed in a generally frusto-conical shape and terminates at the outer surface 102 of disc 98. In the presently preferred embodiment, the outer surface 102 of disc 98 is formed at an angle of approximately 30° with respect to the inner surface 100 of disc 98. Six air jet bores 110 are formed in the disc 98, preferably at an angle of about 30° relative to the longitudinal axis of the discharge bore 44 in nozzle tip 42, by drilling from the angled, outer surface 102 of disc 98 toward its inner surface 100 and into the groove 103 formed in disc 98. The diameter of the air jet bores 110 is in the range of about 0.010 to 0.040 inches, and most preferably in the range of about 0.017 to 0.019 inches. The angulation of the outer surface 102 of disc 98 facilitates accurate drilling of the air jet bores 110 so that they are disposed at the desired angle relative to the discharge bore 44 of nozzle tip 42. That is, by forming the outer surface 102 of disc 98 at a 30° angle, a drill bit can enter the disc 98 at a 30° angle relative to the inner surface 100, but contact the angled outer surface 102 of disc 98 at a 90° angle. As a result, the drilling operation is performed with minimal slippage between the drill bit and disc 98 to ensure the formation of accurately positioned air jet bores 110. Moreover, any burrs or residue from the drilling operation are readily accessible and can be removed with a microblaster of the type, for example, sold by S. S. White Industrial Products under the registered trademark AIRBRASIVE 6500 System.

Figure 3:
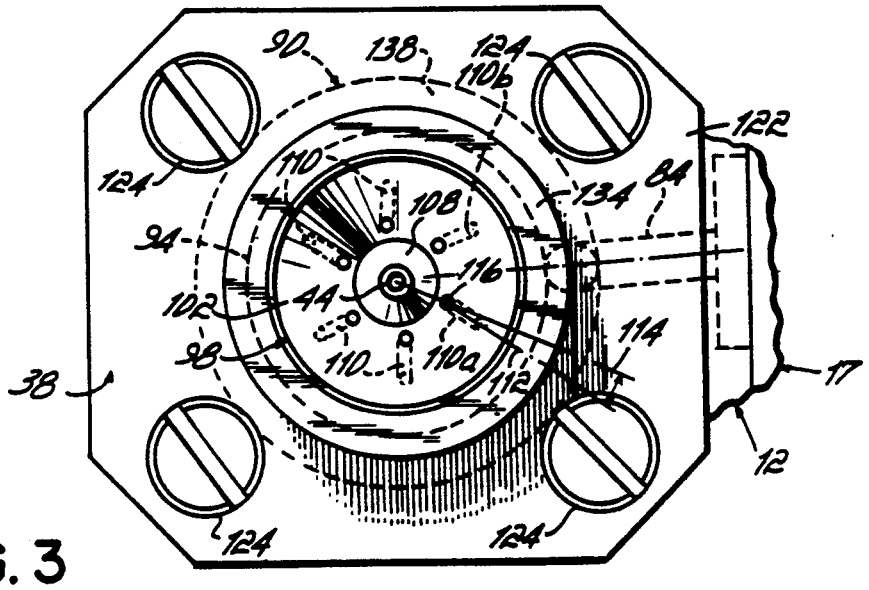
FIG. 3 is a bottom view of the nozzle showing the adhesive discharge bore and air jet bores at the discharge end of the nozzle.

As shown in FIG. 3, the longitudinal axis of each of the air jet bores 110 is angled approximately 10° with respect to a vertical plane passing through the longitudinal axis of the discharge bore 44 of nozzle tip 42 and the center of each such bore 110 at the annular groove 103. For example, the longitudinal axis 112 of air jet bore 110*a* is angled approximately 10° relative to a vertical plane passing through the longitudinal axis 114 of discharge bore 44 and the center point 116 of bore 110*a* at the annular groove 103 in disc 98. As a result, the jet of pressurized air 118 ejected from the air jet bore 110*a* is directed downwardly and substantially tangent to the outer periphery of the discharge bore 44, and the adhesive bead ejected therefrom, as described below.

In the presently preferred embodiment, the nozzle cap 38 is formed with a flange 122 which receives four mounting bolts 124. These mounting bolts 124 extend from the flange 122 through the center portion 88 of nozzle 14 and into the dispenser body 12 to securely mount the nozzle 14 to the bottom of dispenser body 12. Preferably, an insulating annular groove 126 is formed in the flange 122 where it engages the center portion 88 of nozzle 14 to at least partially reduce the transfer of heat from such center portion 88 to flange 122 so that heat is more effectively transferred directly to the nozzle 14.

As depicted in FIG. 2, the nozzle cap 38 is formed with a throughbore which defines an inner wall 130 having an annular-shaped upper portion 132, a stepped lower portion forming a flange 134 and an intermediate portion 136 which extends radially inwardly from the upper portion 132 to the flange 134. With the nozzle 14 and nozzle cap 38 assembled as shown in FIG. 2, the inner wall 130 of nozzle cap 38 faces the discharge end 90 of the nozzle 14. In this assembled position, the upper portion 132 of inner wall 130 of nozzle cap 38 faces the annular recess 92 of nozzle 14 thus defining an air cavity 138 therebetween which connects to the connector bore 84 formed in the center portion 88 of nozzle 14. The intermediate portion 136 of inner wall 130 faces the outer surface 96 of the nozzle's discharge end 90, forming an air passage 140 therebetween which extends from the air cavity 138 to the disc 98. The flange 134 of the stepped lower portion of nozzle cap 38 engages the O-ring 106 carried by seat 104 of disc 98 to create a seal thereat and to assist in retaining the nozzle 14 in position on the dispenser body 12. The baffle 94 formed at the discharge end 90 of nozzle 14 is located between the air cavity 138 and air passage 140 for purposes described below. As shown in FIG. 2, the air passage 140 terminates at the annular groove 103 located at the inner surface 100 of disc 98 wherein the inlet to each of the air jet bores 110 is formed.

Operation of Adhesive Dispenser

The operation of the adhesive dispenser 10 of this invention is as follows. Heated hot melt adhesive is introduced into the adhesive cavity 30 of the dispenser body 12 through the adhesive inlet line 74. Adhesive flows from the adhesive cavity 30 into the stepped adhesive passageway 40 formed in the nozzle 14. With the tip 48 of the plunger 22 in engagement with the seat 46 formed at the entrance to the discharge bore 44 of nozzle tip 42, the adhesive is not permitted to flow therethrough. In order to retract the plunger 22 and permit the flow of adhesive into the nozzle tip 42, operating air is introduced through the operating air line 78 into the air cavity 20 in the dispenser body 12. This pressurized air acts against the seal 24 connected to the plunger 22 which forces the plunger 22 upwardly so that its tip 48 disengages the seat 46 at the entrance to the discharge bore 44 of nozzle tip 42. The plunger 22 is returned to its closed position by discontinuing the flow of air to the air cavity 20 allowing the return spring (not shown) to move the plunger 22 back to its seated position.

The flow of hot melt adhesive entering the nozzle tip 42 is enitted from its discharge bore 44 as an adhesive bead 150. See FIG. 1. At the same time the adhesive bead 150 is formed and ejected from the nozzle tip 42, pressurized air is directed from the air manifold 17 along a flow path defined by the air inlet line 82, air connector bore 84, air cavity 138 and air passage 140 to each of the air jet bores 110 formed in the disc 98 of nozzle 14. In the course of transmission from the air cavity 138 into the air passage 140, the air is impacted by the baffle 94 located therebetween. This baffle 94 is effective to at least assist in providing substantially even distribution of the air to each of the air jet bores 110 as described in detail in U.S. patent application Ser. No. 07/783,989, entitled "Loop Producing Apparatus", which is owned by the assignee of this invention and the disclosure of which is incorporated by reference in its entirety herein.

Additionally, it has been found that the position of the air connector bore 84 relative to the air jet bores 110 contributes to obtaining even distribution of air into each of the air jet bores 110. As depicted in FIG. 3, the air connector bore 84 is oriented relative to the air jet bores 110 such that its outlet is positioned substantially at the midpoint between two adjacent air jet bores 110*a* and 110*b*. This relative orientation is possible in the dispenser 10 herein because the nozzle 14 is of one-piece construction and is fixed at a predetermined position on the dispenser body 14 by bolts 124. As a result, the relative position of air connector bore 84 and air jet bores 110*a*, 110*b* can be precisely controlled so that the air flow from air connector bore 84 into the air passage 140 begins at a location substantially precisely between two adjacent air jet bores such as air jet bores 110*a*, 110*b*.

Having received an essentially equal volume of air from the air passage 140, the air jet bores 110 each direct a jet of air 118 substantially tangent to and at an angle relative to the adhesive bead emitted from the discharge bore 44 of nozzle tip 42. The air jets 118 first attenuate or stretch the adhesive bead 150 forming an elongated strand or fiber 152 of hot melt adhesive and then impart a twisting or swirling motion to the elongated fiber 152 so that it is deposited in a compact, spiral pattern on a substrate. As discussed in U.S. Ser. No. 07/783,989, even distribution of the air flow to each of the air jet bores 110 ensures that the resulting spiral pattern has a substantially constant width, regardless of the angular orientation of the dispenser 10 relative to a substrate.

Because the nozzle 14 is a one-piece construction, heat is directly conducted throughout the entire mass of the nozzle 14 as a result of its contact with the dispenser body 14, which, in turn, directly contacts the adhesive manifold 17 carrying heater 70. As a result, the temperature of the hot melt adhesive is substantially maintained within the nozzle 14, all the way to its disc 98 and nozzle tip 42. This contributes to the production of a consistent spiral pattern of an adhesive fiber 152 on the substrate. Additionally, because the tip 48 of plunger 22 engages the seat 46 located immediately adjacent the discharge bore 44 of nozzle tip 42, an extremely small area or volume is formed between the plunger tip 48 and the discharge outlet 44 of nozzle tip 42. As a result, minimal leakage or drooling of adhesive occurs when the plunger 22 is moved to a closed position, particularly during intermittent operation of dispenser 10. This avoids clogging of the discharge bore 44 of nozzle tip, and clogging of the air jet bores 110 located proximate the nozzle tip 42.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all of the embodiments falling within the scope of the appended claims.

We claim:

1. A nozzle for use with an adhesive dispenser which includes an adhesive supply passage and a plunger movable within the supply passage, comprising:

a nozzle body formed with a throughbore having a discharge outlet, said nozzle body having an outer surface and a plurality of fluid jet bores oriented at an angle relative to said discharge outlet;

a nozzle cap for mounting said nozzle body to the adhesive dispenser in position so that said throughbore in said nozzle body communicates with the adhesive supply passage in the dispenser and the plunger of the dispenser extends into said nozzle body upstream from said discharge outlet of said through-bore, said nozzle cap having an inner surface which faces said outer surface of said nozzle body to form a fluid passage therebetween for the transmission of fluid to said fluid jet bores;

the plunger of the dispenser being adapted to be movable with respect to said discharge outlet of said throughbore to an open position to permit the discharge of a bead of hot melt adhesive from said discharge outlet, said fluid jet bores being effective to emit fluid jets which impact the adhesive bead to form an elongated adhesive fiber and which impart a swirling motion to said elongated adhesive fiber so that it is deposited in a spiral pattern on a substrate.

2. The nozzle of claim 1 in which said nozzle body is formed with a seat located immediately upstream from said discharge outlet, the plunger of the adhesive dispenser being adapted to engage said seat so that a minimal quantity of adhesive is present within said throughbore upstream from said discharge outlet thereof.

3. The nozzle of claim 1 in which said outer surface of said nozzle body includes a radially outwardly extending baffle located in the path of the fluid transmitted through said fluid passage formed between said inner surface of said nozzle cap and said outer surface of said nozzle body, said baffle being effective to substantially evenly distribute said fluid flow into each of said fluid jet bores.

4. A nozzle for use with an adhesive dispenser which includes an adhesive supply passage and a plunger movable within the adhesive supply passage, comprising:

a one-piece nozzle body having a first end adapted to engage the adhesive dispenser and a discharge end, said discharge end being formed with a nozzle tip, an annular disc substantially concentric to said nozzle tip and an outer surface;

said one-piece nozzle body including a throughbore and a discharge outlet formed in said nozzle tip which is connected to said throughbore, said nozzle body being formed with a seat at the intersection of said throughbore and said discharge outlet;

said disc of said one-piece nozzle body being formed with a plurality of fluid jet bores oriented at an angle relative to said discharge outlet formed in said nozzle tip;

a nozzle cap for mounting said one-piece nozzle body to the adhesive dispenser in position so that said throughbore of said nozzle body communicates with the adhesive supply passage in the adhesive dispenser and the plunger of the adhesive dispenser extends into said nozzle body in position to engage said seat, said nozzle cap having an inner surface which faces said outer surface of said nozzle body to form a fluid passage therebetween for the transmission of fluid to said fluid jet bores formed in said disc;

the plunger of the adhesive dispenser being adapted to be movable with respect to said seat at said nozzle tip to an open position to permit the discharge of a bead of hot melt adhesive from said discharge outlet, said fluid jet bores being effective to emit fluid jets which impact the adhesive bead to form an elongated adhesive fiber and which impart a swirling motion to said elongated adhesive fiber so that it is deposited in a spiral pattern on a substrate.

5. The nozzle of claim 4 in which said disc is formed with a first surface and a second surface spaced from said first surface, said disc including an annular groove extending from said first surface toward said second surface, one end of each of said fluid jet bores terminating within said annular groove.

6. The nozzle of claim 5 in which said second surface of said disc is angled relative to said first surface thereof such that said fluid jet bores are oriented substantially perpendicular to said second surface and at an angle of about 30° relative to said first surface.

7. The nozzle of claim 5 in which said nozzle tip is substantially frusto-conical in shape and terminates at said second surface of said disc.

8. The nozzle of claim 4 in which said outer surface of said nozzle body includes a radially outwardly extending baffle located in the path of the fluid transmitted through said fluid passage formed between said inner surface of said nozzle cap and said outer surface of said nozzle body, said baffle being effective to substantially evenly distribute said fluid flow within said fluid passage to each of said fluid jet bores.

9. A nozzle for use with an adhesive dispenser which includes an adhesive supply passage and a plunger movable within the supply passage, comprising:

a nozzle body formed with a throughbore having a discharge outlet, said nozzle body having an outer surface and a plurality of spaced fluid jet bores each oriented at an angle relative to said discharge outlet;

a nozzle cap for mounting said nozzle body to the adhesive dispensing device in position so that said throughbore in said nozzle body communicates with the adhesive supply passage in the dispenser and the plunger of the dispenser extends into said nozzle body upstream from said discharge outlet of said throughbore, said nozzle cap having an inner surface which faces said outer surface of said nozzle body to form a fluid passage therebetween for the transmission of fluid to said fluid jet bores;

one of said nozzle body and nozzle cap being formed with a fluid supply bore having an inlet adapted to connect to a source of pressurized fluid and an outlet which discharges fluid into said fluid passage, said outlet of said fluid supply bore being positioned substantially at the midpoint of the space between two adjacent fluid jet bores;

the plunger of the dispenser being adapted to be movable with respect to said discharge outlet of said throughbore to an open position to permit the discharge of a bead of hot melt adhesive from said discharge outlet, said fluid jet bores being effective to emit fluid jets which impact the adhesive bead to form an elongated adhesive fiber and which impart a swirling motion to said elongated adhesive fiber so that it is deposited in a spiral pattern on a substrate.

10. The nozzle of claim 9 in which said nozzle body includes a disc having a first surface and a second surface spaced from said first surface, said disc including an annular groove extending from said first surface toward said second surface in which one end of each of said fluid bores terminates, said fluid jet bores being circumferentially spaced from one another within said annular groove and said fluid supply bore being positioned with respect to two adjacent fluid jet bores such that said outlet of said fluid supply bore is located at the midpoint of said space therebetween.

11. Apparatus for dispensing hot melt adhesive, comprising:

a dispenser body formed with an adhesive passageway adapted to connect to a source of hot melt adhesive, said dispenser body carrying a plunger which is movable within said adhesive passageway;

a nozzle assembly formed with a throughbore having a discharge outlet, said nozzle assembly being mounted to said dispenser body in position so that said throughbore in said nozzle body communicates with said adhesive passageway in said dispenser body and said plunger is movable between an open and closed position relative to said discharge outlet of said throughbore;

said nozzle assembly being formed with a plurality of spaced fluid jet bores oriented at an angle relative to said throughbore, a fluid passage connected to said fluid jet bores and a fluid supply bore, said fluid supply bore having an inlet adapted to connect to a source of pressurized fluid and an outlet connected to said fluid passage at a position which is substantially at the midpoint of the space between two adjacent fluid jet bores;

said plunger being movable with respect to said discharge outlet of said throughbore in said nozzle assembly to an open position to permit the discharge of a bead of hot melt adhesive from said discharge outlet, said fluid jet bores being effective to emit fluid jets which impact the adhesive bead to form an elongated adhesive fiber and which impart a swirling motion to said elongated adhesive fiber so that it is deposited in a spiral pattern on a substrate.

12. The apparatus of claim 11 in which said nozzle assembly includes a one-piece nozzle body formed with said throughbore and said fluid jet bores, and a nozzle cap which mounts said nozzle body to said dispenser body.

13. The apparatus of claim 12 in which said nozzle body comprises:

a first end engageable with said dispenser body, and a discharge end;

said discharge end being formed with a nozzle tip, an annular disc substantially concentric to said nozzle tip and an outer surface;

said annular disc of said nozzle body being formed with said fluid jet bores.

14. The apparatus of claim 13 in which said disc is formed with a first surface and a second surface spaced from said first surface, said disc including an annular groove extending from said first surface toward said second surface, one end of each of said fluid jet bores terminating within said annular groove.

15. The apparatus of claim 14 in which said second surface of said disc is angled relative to said first surface thereof such that said fluid jet bores are oriented substantially perpendicular to said second surface and at an angle of about 30° relative to said first surface.

16. The apparatus of claim 14 in which said nozzle tip is substantially frusto-conical in shape and terminates at said second surface of said disc.

17. The apparatus of claim 13 in which said nozzle cap is formed with an inner surface which faces said outer surface of said nozzle body to form said fluid passage therebetween for the transmission of fluid to said fluid jet bores formed in said disc.

18. The apparatus of claim 17 in which said outer surface of said nozzle body includes a radially outwardly extending baffle located in the path of the fluid transmitted through said fluid passage formed between said inner surface of said nozzle cap and said outer surface of said nozzle body, said baffle being effective to substantially evenly distribute said fluid flow within said fluid passage to each of said fluid jet bores.

19. Apparatus for dispensing hot melt adhesive, comprising:

a dispenser body formed with an adhesive passageway adapted to connect to a source of hot melt adhesive, said dispenser body carrying a plunger which is movable within said adhesive passageway;

a one-piece nozzle body having a first end engageable with said dispenser body and a discharge end, said discharge end being formed with a nozzle tip, an annular disc substantially concentric to said nozzle tip and an outer surface;

said one-piece nozzle body including a throughbore and a discharge outlet formed in said nozzle tip which is connected to said throughbore, said nozzle body being formed with a seat at the intersection of said throughbore and said discharge outlet;

said disc of said one-piece nozzle body being formed with a plurality of fluid jet bores oriented at an angle relative to said discharge outlet formed in said nozzle tip;

a nozzle cap for mounting said one-piece nozzle body to said dispenser body in position so that said throughbore of said nozzle body communicates with the adhesive passageway in said dispenser body and said plunger extends into said nozzle body in position to engage said seat, said nozzle cap having an inner surface which faces said outer surface of said nozzle body to form a fluid passage therebetween for the transmission of fluid to said fluid jet bores formed in said disc;

said plunger being movable with respect to said seat at said valve tip to an open position to permit the discharge of a bead of hot melt adhesive from said discharge outlet, said fluid jet bores being effective to emit fluid jets which impact the adhesive bead to form an elongated adhesive fiber and which impart a swirling motion to said elongated adhesive fiber so that it is deposited in a spiral pattern on a substrate.

20. A method of depositing an elongated adhesive fiber in a spiral pattern onto a substrate, comprising:

transmitting heated hot melt adhesive from an adhesive dispenser into an adhesive bore formed in a one-piece nozzle which is directly mounted to the adhesive dispenser by a nozzle cap;

discharging an adhesive bead from the discharge bore of a nozzle tip formed at one end of the one-piece nozzle;

transmitting fluid along a fluid passage formed between an outer surface of the one-piece nozzle and an inner surface of the nozzle cap to a number of fluid jet bores formed in a disc portion of the one-piece nozzle;

emitting a fluid jet from each of said fluid jet bores which impact the adhesive bead to form an elongated adhesive fiber, and which impart a swirling motion to said elongated adhesive fiber so that it is deposited in a spiral pattern onto a substrate.

21. The method of claim 20 in which said step of transmitting fluid along a fluid passage comprises introducing a flow of fluid into said fluid passage at a point which is located substantially at the midpoint of a space between two adjacent fluid jet bores so that the fluid flow is supplied evenly to each of the fluid jet bores.

* * * * *